US009591700B2

(12) United States Patent
Armstrong et al.

(10) Patent No.: US 9,591,700 B2
(45) Date of Patent: Mar. 7, 2017

(54) MICROWAVE APPLIANCE AND A METHOD FOR OPERATING THE SAME

(71) Applicant: General Electric Company, Schenectady, NY (US)

(72) Inventors: James Lee Armstrong, Louisville, KY (US); Joshua Stephen Wiseman, Elizabethtown, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 687 days.

(21) Appl. No.: 14/021,106

(22) Filed: Sep. 9, 2013

(65) Prior Publication Data

US 2015/0069049 A1 Mar. 12, 2015

(51) Int. Cl.
*H05B 6/64* (2006.01)

(52) U.S. Cl.
CPC ..... *H05B 6/6423* (2013.01)

(58) Field of Classification Search
USPC ..... 219/757
See application file for complete search history.

(56) References Cited

U.S. PATENT DOCUMENTS 5,334,248 A 8/1994 Kwak
5,803,804 A 9/1998 Meier et al.
6,170,480 B1 * 1/2001 Melink ..... F24C 15/2021 126/299 D
6,974,937 B2 * 12/2005 Kim ..... H05B 6/6461 126/299 D
7,049,569 B2 * 5/2006 Kim ..... F24C 15/2021 126/21 A
2012/0083198 A1 4/2012 Sinur et al.

OTHER PUBLICATIONS

Chris Woodford, Explainthatstuff—Smoke Detectors, http://www.explainthatstuff.com/smokedetector.html Originally Published 2007: https://web.archive.org/web/20070429174336/http://www.explainthatstuff.com/smokedetector.html.*

* cited by examiner

*Primary Examiner* — Brian Jennison
(74) *Attorney, Agent, or Firm* — Dority & Manning, P.A.

(57) ABSTRACT

A microwave appliance and method for operating a microwave appliance are provided. The method includes operating a fan of the microwave appliance in order to draw a flow of air through a circulation conduit of the microwave appliance, measuring an air quality of the flow of air within the circulation conduit with a sensor of the microwave appliance, and deactivating the fan of the microwave appliance if the air quality of the flow of air within the circulation conduit of the microwave appliance exceeds a threshold value. In such a manner, the flow or air can be properly filtered without operating the fan of the microwave appliance excessively.

13 Claims, 4 Drawing Sheets

FIG. —1—

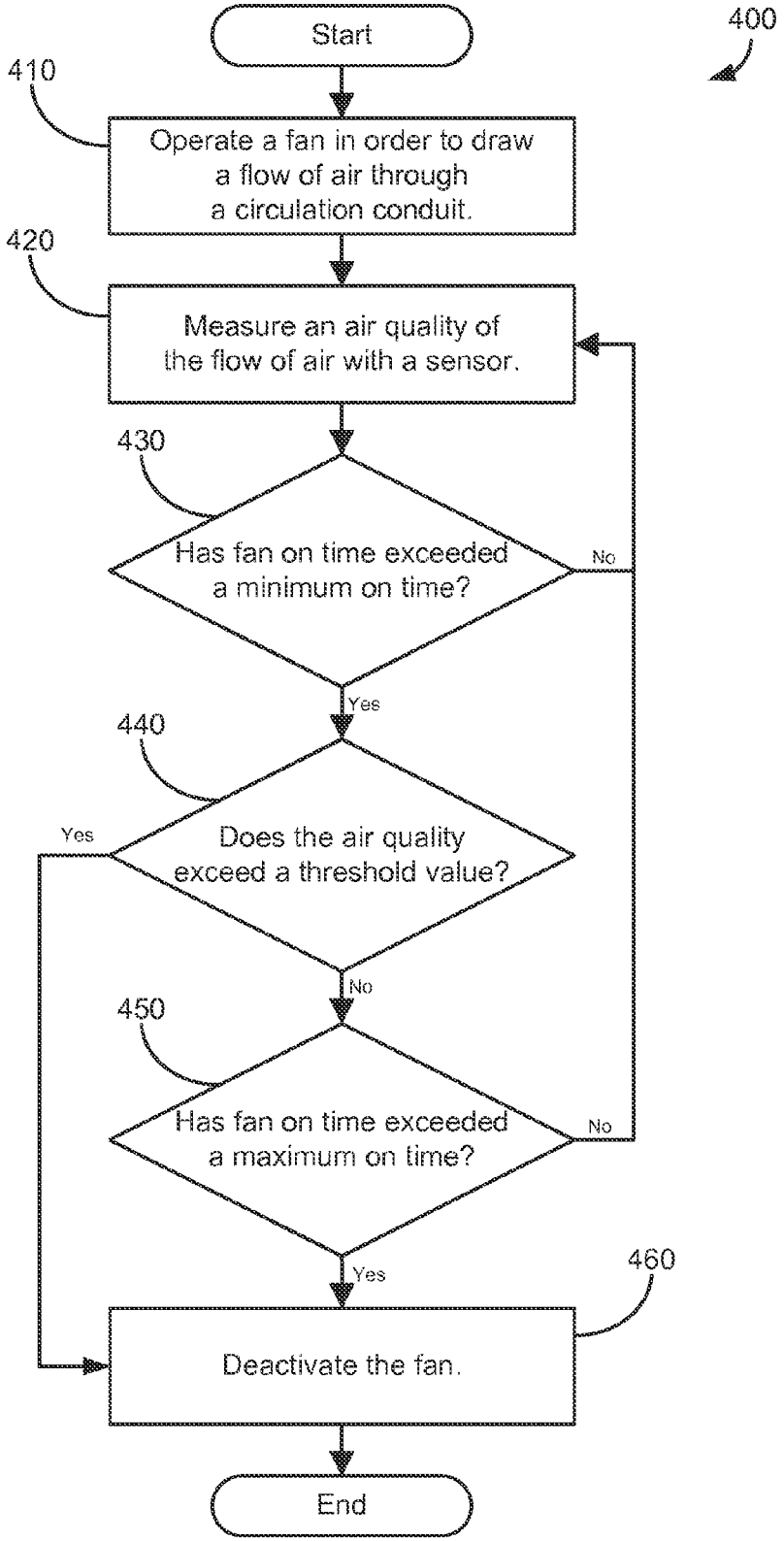
FIG. —4—

MICROWAVE APPLIANCE AND A METHOD FOR OPERATING THE SAME

FIELD OF THE INVENTION

The present subject matter relates generally to microwave appliances, such as over-the-range microwave appliances, and methods for operating microwave appliances.

BACKGROUND OF THE INVENTION

Over-the-range microwave appliances are generally mounted above a cooktop of an oven range appliance. In addition to providing for heating of food and beverage items, certain over-the-range microwave appliances include a circulation system. When activated, the circulation system can draw fumes, smoke, grease, and/or steam away from the cooktop of the oven range appliance. Circulation systems generally include a fan for drawing a flow of air into the circulation system and a grease filter for trapping grease entering the circulation system. Certain over-the-range microwave appliances also include air filters for filtering air passing through the microwave appliances' circulation systems. The circulation assembly's air filter can assist with removing dust, particulates, and/or other undesirable substances from air passing therethrough.

Over-the-range microwave appliances generally activate the circulation system's fan for a predetermined time interval in order to filter the air with the circulation system's air filter. After the predetermined time interval elapses, the fan is deactivated and the circulation system stops filtering air. A user can also manually deactivate the fan prior to the predetermined time interval elapsing in order to stop filtering air with the circulation system. Filtering air in such a manner has certain drawbacks. For example, the predetermined time interval can overly long such that the fan operates unnecessarily. Operating the fan excessively can be expensive, wasteful and noisy. As another example, the predetermined time interval can too short such that air is not adequately filtered.

Accordingly, a microwave appliance with features for assisting with filtering air with a circulation system of the microwave appliance would be useful. In particular, a microwave appliance with features for assisting with suitably filtering air with a circulation system of the microwave appliance without operating the circulation system's fan excessively would be useful.

BRIEF DESCRIPTION OF THE INVENTION

The present subject matter provides a microwave appliance and method for operating the same. The method includes operating a fan of the microwave appliance in order to draw a flow of air through a circulation conduit of the microwave appliance, measuring an air quality of the flow of air within the circulation conduit with a sensor of the microwave appliance, and deactivating the fan of the microwave appliance if the air quality of the flow of air within the circulation conduit of the microwave appliance exceeds a threshold value. In such a manner, the flow or air can be properly filtered without operating the fan of the microwave appliance excessively. Additional aspects and advantages of the invention will be set forth in part in the following description, or may be apparent from the description, or may be learned through practice of the invention.

In a first exemplary embodiment, a microwave appliance is provided. The microwave appliance includes a casing that defines a chamber configured for receipt of food items for cooking and a circulation conduit. The circulation conduit has an inlet and an outlet. A door is mounted to the casing and is configured for permitting selective access to the chamber of the casing. A fan is positioned within the circulation conduit of the casing. The fan draws a flow of air into the circulation conduit through the inlet of the circulation conduit when the fan is in an activated state. An air filter is mounted to the casing such that the flow of air within the circulation conduit passes through the air filter when the fan is in the activated state. A sensor is also mounted to the casing. The sensor is configured for measuring an air quality of the flow of air within the circulation conduit. A controller is in operative communication with the fan and the sensor. The controller is configured for operating the fan in order to draw the flow of air through the circulation conduit of the casing, measuring the air quality of the flow of air within the circulation conduit with the sensor during the step of operating, and deactivating the fan if the air quality of the flow of air within the circulation conduit exceeds a threshold value at the step of measuring.

In a second exemplary embodiment, a method of operating a microwave appliance is provided. The method includes operating a fan of the microwave appliance in order to draw a flow of air through a circulation conduit of the microwave appliance, measuring an air quality of the flow of air within the circulation conduit with a sensor of the microwave appliance during the step of operating, and deactivating the fan of the microwave appliance if the air quality of the flow of air within the circulation conduit of the microwave appliance exceeds a threshold value at the step of measuring.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 4 illustrates a method of operating a microwave appliance according to an exemplary embodiment of the present subject matter.

DETAILED DESCRIPTION

Figure 1:
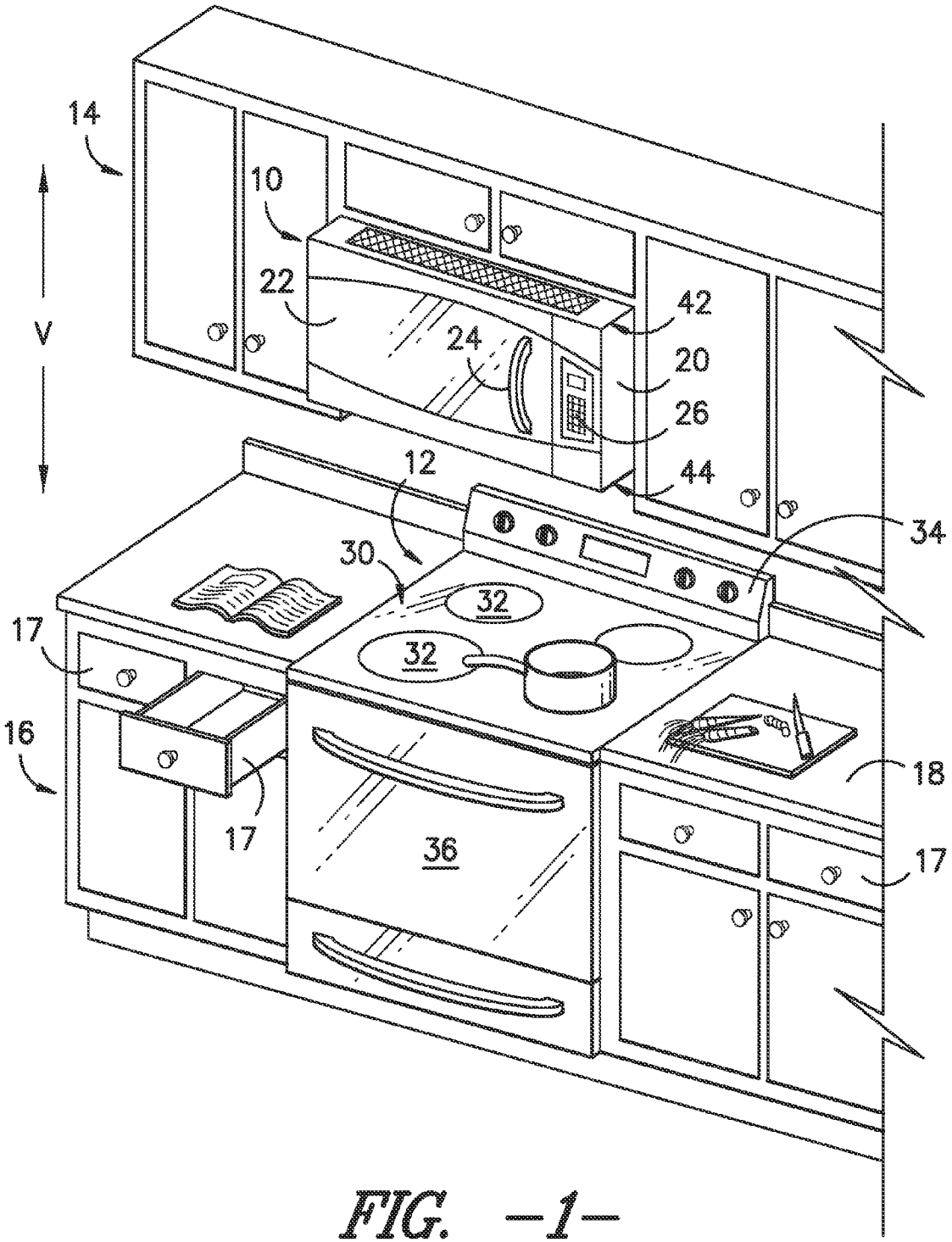
FIG. 1 provides a perspective view of a microwave appliance according to an exemplary embodiment of the present subject matter mounted to a kitchen cabinet above an oven range appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a microwave appliance 10 according to an exemplary embodiment of the present subject matter mounted to an upper set of kitchen cabinets 14 above an oven range appliance 12, e.g., along a vertical direction V. Microwave appliance 10 shown in FIG. 1 is commonly referred to as an over-the-range microwave. It should be understood that, in alternative exemplary embodiments, the present subject matter may be used in any other suitable microwave appliance.

As discussed above, microwave appliance 10 is mounted to upper set of kitchen cabinets 14. Upper set of kitchen cabinets 14 is positioned above a base set of kitchen cabinets 16, e.g., along the vertical direction V. Base set of kitchen cabinets 16 includes countertops 18 and drawers 17. Microwave appliance 10 is positioned above base set of kitchen cabinets 16, e.g., along the vertical direction V. Oven range appliance 12 is received within base set of kitchen cabinets 16 below microwave appliance 10. In particular, a cooking surface 30 of oven range appliance 12 is positioned, e.g., directly, below microwave appliance 10 along the vertical direction V. Microwave appliance 10 can include features such as an air handler or fan 52 (FIG. 2) that can draw cooking vapors and/or smoke away from cooking surface 30 and out of the kitchen containing microwave and oven range appliances 10 and 12.

Microwave appliance 10 is configured for receipt of food items for cooking. In particular, microwave appliance 10 includes a cabinet or casing 20 and a door 22 that permits selective access to an interior of microwave appliance 10 and casing 20. Door 22 includes a handle 24 that a user can pull to open door in order to insert food items into microwave appliance 10. Microwave appliance 10 also includes controls 26 that permit a user to make selections for cooking of food items, e.g., a duration of a cooking cycle of microwave appliance 10 and/or a power setting for the cooking cycle of microwave appliance 10.

As discussed above, oven range appliance 12 includes cooking surface 30. Cooking surface 30 includes heated portions 32 that may be heated by heating elements (not shown), e.g., electrical resistive heating elements, gas burners, induction heating elements, and/or any other suitable heating element of combination of heating elements. Oven range appliance 12 also includes a door 36 that permits access to a heated compartment (not shown) of oven range appliance 12, e.g., for cooking or baking of food items therein. A control panel 34 of oven range appliance 12 can permit a user to make selections for cooking of food items, e.g., a duration of a cooking cycle of oven range appliance 12 and/or a power setting for the cooking cycle of oven range appliance 12.

Figure 2:
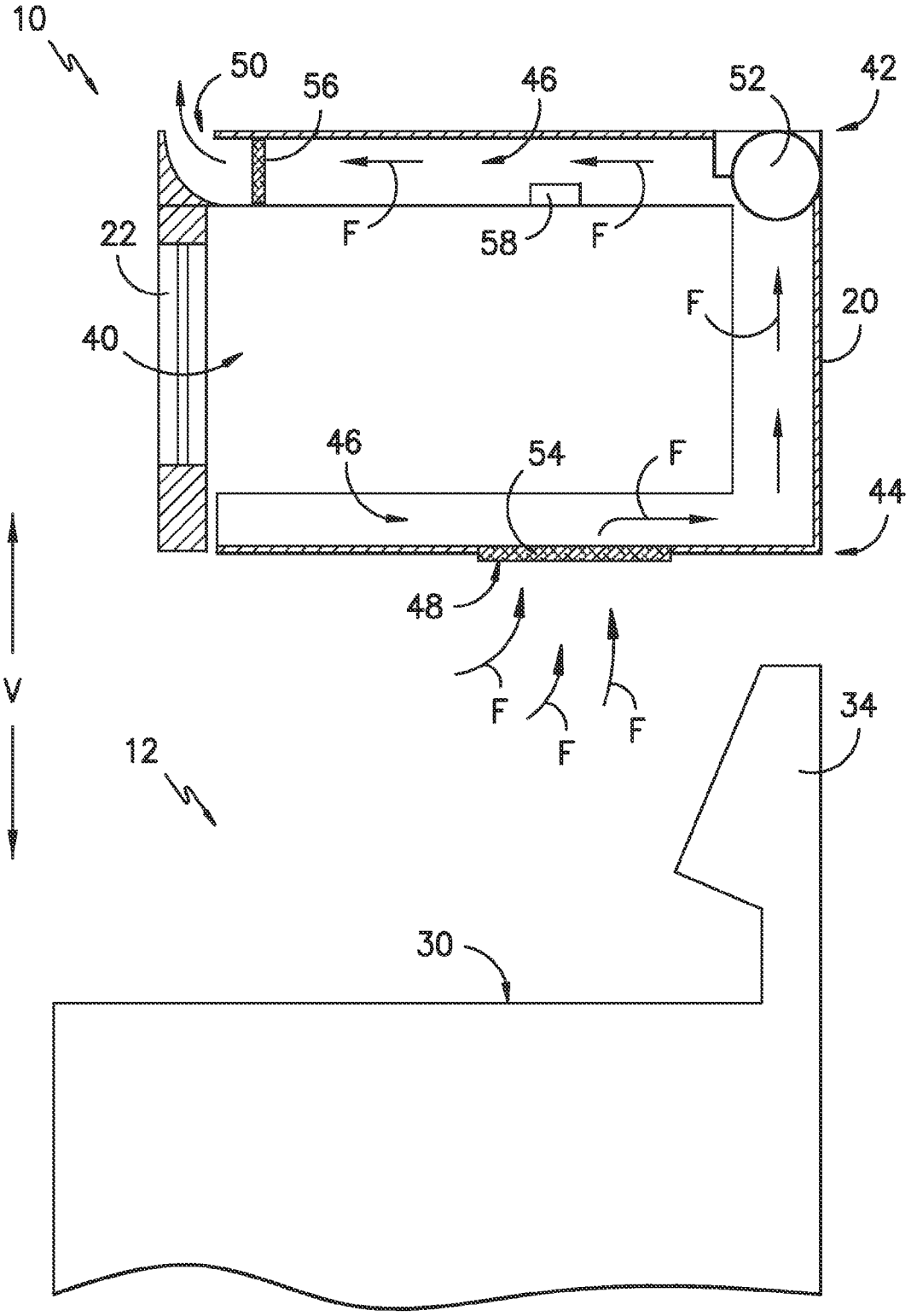
FIG. 2 provides a side, section view of the exemplary microwave appliance and the oven range appliance of FIG. 1.
Figure 3:
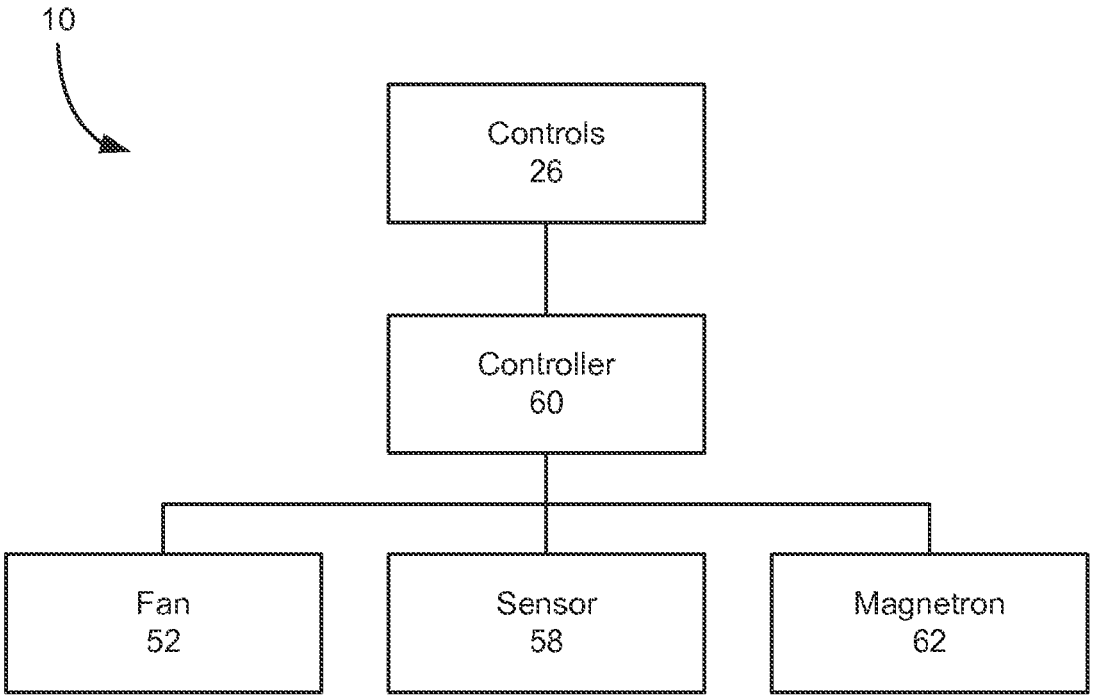
FIG. 3 provides a schematic view of certain components of the exemplary microwave appliance of FIG. 1.

FIG. 2 provides a side, section view of microwave appliance 10 and oven range appliance 12. FIG. 3 provides a schematic view of certain components of microwave appliance 10. As may be seen in FIG. 2, casing 20 extends between a top portion 42 and a bottom portion 44, e.g., along the vertical direction V. Thus, top and bottom portions 42 and 44 of casing 20 are spaced apart from each other, e.g., along the vertical direction V. Casing 20 defines a cooking chamber 40 configured for receipt of food items for cooking. Door 22 of microwave appliance 10 permits selective access to cooking chamber 40 of casing 20. In particular, door 22 of microwave appliance 10 is selectively adjustable between an open position (not shown) and a closed position (FIGS. 1 and 2). In the closed position, door 22 of microwave appliance 10 hinders access to cooking chamber 40 of casing 20. Conversely, door 22 of microwave appliance 10 permits access to cooking chamber 40 of casing 20 in the open position. A user can pull on handle 24 of door 22 of microwave appliance 10 in order to shift door 22 from the closed position shown in FIG. 2 to the open position.

Casing 20 also defines a circulation passage or conduit 46. Circulation conduit 46 has an inlet 48 and an outlet 50. Circulation conduit 46 extends between inlet 48 and outlet 50. Inlet 48 of circulation conduit 46 is positioned at or adjacent bottom portion 44 of casing 20, e.g., such that inlet 48 of circulation conduit 46 faces cooking surface 30 of oven range appliance 12. Conversely, outlet 50 of circulation conduit 46 is positioned at or adjacent top portion 42 of casing 20, e.g., such that outlet 50 of circulation assembly 46 faces away from cooking surface 30 of oven range appliance 12. Thus, inlet 48 and outlet 50 of circulation conduit 46 are spaced apart from each other, e.g., along the vertical direction V.

Microwave appliance 10 also includes a fan 52, such as an axial fan or a radial fan. Fan 52 is positioned within or adjacent circulation conduit 46. Fan 52 draws or urges a flow of air (shown with arrows F) through circulation conduit 46 when fan 52 is in an activated state. Conversely, fan 52 does not draw or urge flow of air F through circulation conduit 46 when fan 52 is in a deactivated state. When fan 52 is in the activated state, flow of air F enters circulation conduit 46 at or through inlet 48 of circulation conduit 46. Flow of air F is directed through circulation conduit 46 to outlet 50, and flow of air F can exit circulation conduit 46 at outlet 50 of circulation conduit 46.

A grease filter 54 is positioned within circulation conduit 46. In particular, grease filter 54 is positioned at or adjacent inlet 48 of circulation conduit 46. Grease filter 54 can assist with removing or filtering grease or other large particles from flow of air F when flow of air F passes through grease filter 54 at inlet 48 of circulation conduit 46. Grease filter 54 may be constructed with an aluminum mesh or a baffle assembly.

Microwave appliance 10 also includes an air filter 56. Air filter 56 is mounted to casing 20 such that flow of air F within circulation conduit 46 passes through air filter 56 when fan 52 is in the activated state. In the exemplary embodiment shown in FIG. 2, air filter 56 is positioned within circulation conduit 46 at outlet 50 of circulation conduit 46. It should be understood that in alternative exemplary embodiments, air filter 56 may be positioned at any other suitable location on microwave appliance 10.

As may be seen in FIG. 2, air filter 56 is positioned downstream of grease filter 54 in flow of air F. In such a manner, grease filter 54 can filter grease and other large particles from flow of air F before flow of air F passes through air filter 56. Grease filter 54 can improve a lifetime of air filter 56 by removing such contaminants from flow of air F rather than air filter 56. Thus, grease filter 54 can be configured for removing relatively large particles from flow of air F, and air filter 56 can be configured for removing relatively small particles from flow of air F. Air filter 56 can be any suitable filter or mechanism for removing particles from flow of air F. For example, air filter 56 may be a charcoal air filter, a high-efficiency particulate air filter, or an electrostatic air filter.

A sensor 58 is mounted to casing 20. Sensor 58 is configured for measuring an air quality of flow of air F within circulation conduit 46. In FIG. 2, sensor 58 is positioned within circulation conduit 46 of casing 20. It should be understood that in alternative exemplary embodiments, sensor 58 may be positioned at any other suitable location on microwave appliance 10.

Sensor 58 can be any suitable sensor for measuring the air quality of flow of air F. As an example, sensor 58 may be an optical dust sensor. Thus, sensor 58 may be configured for measuring a quantity of particles, such as dust particles, within flow of air F in circulation conduit 46. The quantity of particles in flow of air F can correspond to the air quality of the flow of air F. For example, a high quantity of particles in flow of air F can correspond to a poor air quality. Conversely, a low quantity of particles in flow of air F can correspond to a high air quality. Thus, the quantity of particles in flow of air F can be indirectly proportional to the air quality of the flow of air F such that as the quantity of particles in flow of air F increases the air quality of the flow of air F decreases and vice versa.

As may be seen in FIG. 3, microwave appliance 10 includes a controller 60. Operation of microwave appliance 10 is regulated by controller 60. Controller 60 is operatively coupled or in communication with various components of microwave appliance 10, including controls 26. In response to user manipulation of controls 26, controller 60 operates the various components of microwave appliance 10 to execute selected cycles and features.

Controller 60 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 60 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Controls 26 and other components of microwave appliance 10 may be in communication with controller 60 via one or more signal lines or shared communication busses.

Controller 60 is also in operative communication with fan 52 and sensor 58. Thus, controller 60 can selectively adjust fan 52 between the activated and deactivated states in order to regulate the flow of air F through circulation conduit 46. In particular, controller 60 can receive a signal from sensor 58 correspond to the air quality of flow of air F, and controller 60 can selectively deactivate fan 52 based at least in part on the signal from sensor 58 as discussed in greater detail below.

Microwave appliance 10 also includes a magnetron 62. Magnetron 62 is configured for generating microwaves and directing such microwaves towards or into cooking chamber 40 of casing 20. Magnetron 62 can be positioned at any suitable location within microwave appliance 10. For example, magnetron 62 may be mounted to casing 20, e.g., at or adjacent top portion 42 of casing 20, such that magnetron 62 is positioned at or adjacent cooking chamber 40 of casing 20. Controller 60 can selectively activate magnetron 62, e.g., in order to heat food or beverage items in cooking chamber 40, based at least in part on an activation signal received from controls 26.

FIG. 4 illustrates a method 400 of operating a microwave appliance according to an exemplary embodiment of the present subject matter. Method 400 can be used to operate any suitable microwave appliance. For example, method 400 may be used to operate microwave appliance 10 (FIG. 1). Utilizing method 400, operation of fan 52 can be regulated based upon an air quality measurement from sensor 58, e.g., such that unnecessary operation of fan 52 is avoided.

At step 410, controller 60 operates fan 52 such that fan 52 draws or urges flow of air F through circulation conduit 46. As an example, a user of microwave appliance 10 can utilize controls 26 to activate an air filtering operation of microwave appliance 10. During the air filtering operation, controller 60 can keep fan 52 in the activated operation state in such the flow of air F flows through air filter 56 and flow of air F is filtered with air filter 56.

At step 420, controller 60 measures the air quality of flow of air F within circulation conduit 46 with sensor 58. In particular, controller 60 can receive at least one signal from sensor 58 while fan 52 is drawing flow of air F through circulation conduit 46 during step 410 in order to measure the air quality of flow of air F within circulation conduit 46 at step 420. For example, controller 60 can receive signals from sensor 58 corresponding to the quantity of particles within flow of air F in circulation conduit 46 at step 420.

At step 430, controller 60 determines whether an on time of fan 52 has exceeded a minimum on time. As an example, controller 60 can include a timer feature or function that calculates or determines an elapsed time interval since controller 60 activates fan 52 at step 410. The elapsed time interval can correspond to the on time of fan 52. The minimum on time can be any suitable time period. For example, the minimum on time may be about one minute, about two minutes, about five minutes, about ten minutes, about an hour, etc. The minimum on time can be selected in order to insure that the air filtering operation of microwave appliance 10 has sufficient time to filter flow of air F and/or to avoid excessive cycling of fan 52.

Controller 60 continues to measure the air quality of flow of air F within circulation conduit 46 with sensor 58 at step 420 if the on time of fan 52 has not exceeded the minimum on time at step 430. Conversely, controller 60 determines whether the air quality of flow of air F in circulation conduit 46 exceeds a threshold value at step 440 if the on time of fan 52 exceeds the minimum on time at step 430. At step 440, controller 60 can compare measurements of the air quality of flow of air F within circulation conduit 46 from step 420 to the predetermined value.

During the air filtering operation of microwave appliance 10, flow of air F passes through air filter 56 such that flow of air F is filtered by air filter 56, and flow of air F subsequently passes out of microwave appliance 10 to mix with ambient atmosphere. In such a manner, microwave appliance 10 can filter air within a room housing microwave appliance 10 during the air filtering operation of microwave appliance 10. At step 440, controller 60 monitors the measurements of the air quality of flow of air F within circulation conduit 46 from step 420 in order to establish when the air within the room housing microwave appliance 10 has been suitably filtered. Thus, controller 60 deactivates fan 52 at step 460 if the air quality of flow of air F within circulation conduit 46 exceeds the threshold value at step 440. Conversely, controller 60 continues to operate fan 52 and measure the air quality of flow of air F within circulation conduit 46 at step 420 unless the on time of fan 52 has exceeded a maximum on time if the air quality of flow of air F within circulation conduit 46 does not exceed the threshold value at step 440.

As an example, controller 60 deactivates fan 52 at step 460 if the quantity of particles within flow of air F drops below a predetermined amount at step 440. Conversely, controller 60 continues to operate fan 52 and measure the air quality of flow of air F within circulation conduit 46 at step 420 if the quantity of particles within flow of air F does not exceed the predetermined amount at step 440. The predetermined value may be any suitable value. For example, the predetermined value may be about three parts dust per million parts air.

At step 450, controller 60 determines whether the on time of fan 52 has exceeded a maximum on time. As discussed above, controller 60 can include a timer feature or function that calculates or determines the elapsed time interval since controller 60 activates fan 52 at step 410, and the elapsed time interval can correspond to the on time of fan 52. The maximum on time can be any suitable time period. For example, the maximum on time may be about thirty minutes, about forty-five minutes, about an hour, about two hours, etc. The maximum on time can be selected in order to insure that the air filtering operation of microwave appliance 10 has sufficient time to filter flow of air F while avoiding excessive operating of fan 52.

Controller 60 continues to measure the air quality of flow of air F within circulation conduit 46 with sensor 58 at step 420 if the on time of fan 52 has not exceeded the maximum on time at step 450. Conversely, controller 60 deactivates fan 52 at step 460 if the on time of fan 52 exceeds the maximum on time at step 450. In such a manner, controller 60 can avoid operating fan 52 for excessive periods of time. In particular, method 400 can assist insuring that flow of air F is suitably filtered with air filter 56 while also insuring that fan 52 does not operate excessively.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A microwave appliance, comprising:

a casing that defines a chamber configured for receipt of food items for cooking and a circulation conduit, the circulation conduit having an inlet and a single outlet in fluid communication with ambient atmosphere within a room housing the microwave appliance;

a door mounted to the casing and configured for permitting selective access to the chamber of the casing;

a fan positioned within the circulation conduit of the casing, the fan drawing a flow of air into the circulation conduit through the inlet of the circulation conduit when the fan is in an activated state;

an air filter configured for removing relatively small particles mounted to the casing within the circulation conduit of the casing at the outlet of the circulation conduit such that the flow of air within the circulation conduit passes through the air filter when the fan is in the activated state;

a sensor mounted to the casing, the sensor configured for measuring an air quality of the flow of air within the circulation conduit;

a grease filter configured for removing relatively large particles positioned within the circulation conduit of the casing at the inlet of the circulation conduit; and a controller in operative communication with the fan and the sensor, the controller configured for:

operating the fan in order to draw the flow of air through the circulation conduit of the casing;

measuring the air quality of the flow of air within the circulation conduit with the sensor during said step of operating;

stopping the fan if an elapsed time interval since said step of operating exceeds a maximum on time; and deactivating the fan if the air quality of the flow of air within the circulation conduit exceeds a threshold value at said step of measuring.

2. The microwave appliance of claim 1, wherein the air filter comprises a charcoal air filter, a high-efficiency particulate air filter, or an electrostatic air filter.

3. The microwave appliance of claim 1, wherein the sensor is positioned within the circulation conduit of the casing.

4. The microwave appliance of claim 1, wherein the sensor comprises an optical dust sensor.

5. The microwave appliance of claim 4, wherein the optical dust sensor is configured for measuring a quantity of particles within the flow of air in the circulation conduit in order to determine the air quality of the flow of air within the circulation conduit.

6. The microwave appliance of claim 5, wherein said step of measuring comprises measuring the quantity of particles within the flow of air in the circulation conduit with the optical dust sensor during said step of operating, and said step of deactivating comprises deactivating the fan if the quantity of particles within the flow of air in the circulation conduit drops below a predetermined amount at said step of measuring.

7. The microwave appliance of claim 1, wherein said step of deactivating comprises deactivating the fan if the air quality of the flow of air within the circulation conduit exceeds the threshold value at said step of measuring unless an elapsed time interval since said step operating does not exceed a minimum on time.

8. The microwave appliance of claim 1, wherein the casing extends between a top portion and a bottom portion along a vertical direction, the inlet of the circulation conduit positioned at the bottom portion of the casing, the outlet of the circulation conduit positioned at the top portion of the casing.

9. The microwave appliance of claim 1, wherein the casing is positioned above a range appliance along a vertical direction.

10. A method of operating a microwave appliance, comprising:

operating a fan of the microwave appliance in order to draw a flow of air through a circulation conduit of the microwave appliance such that the flow of air passes through an air filter mounted within the circulation conduit and subsequently passes out of the microwave appliance to mix with ambient atmosphere within a room housing the microwave appliance;

measuring an air quality of the flow of air within the circulation conduit with a sensor of the microwave appliance during said step of operating;

stopping the fan of the microwave appliance if an elapsed time interval since said step of operating exceeds a maximum on time; and deactivating the fan of the microwave appliance when the air quality of the flow of air within the circulation conduit of the microwave appliance exceeds a threshold value at said step of measuring unless an elapsed time interval since said step operating does not exceed a minimum on time.

11. The method of claim 10, wherein said step of measuring comprises measuring a quantity of particles within the flow of air in the circulation conduit with the sensor of the microwave appliance during said step of operating, and said step of deactivating comprises deactivating the fan of the microwave appliance if the quantity of particles within the flow of air in the circulation conduit drops below a predetermined amount at said step of measuring.

12. The method of claim 10, wherein said step of operating comprises operating the fan of the microwave appliance in order to draw the flow of air through the circulation conduit of the microwave appliance and an air filter of the microwave appliance.

13. The method of claim 12, wherein the air filter comprises a charcoal air filter, a high-efficiency particulate air filter, or an electrostatic air filter.

* * * * *